US007018180B2

(12) United States Patent
Koo

(10) Patent No.: US 7,018,180 B2
(45) Date of Patent: Mar. 28, 2006

(54) VACUUM PREVENTING DEVICE OF SCROLL COMPRESSOR

(75) Inventor: In-Hwe Koo, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 324 days.

(21) Appl. No.: 10/420,878

(22) Filed: Apr. 23, 2003

(65) Prior Publication Data

US 2003/0206813 A1 Nov. 6, 2003

(30) Foreign Application Priority Data

May 6, 2002 (KR) ..... 10-2002-0024854

(51) Int. Cl.
*F04B 49/00* (2006.01)
*F04B 17/00* (2006.01)
*F01C 1/02* (2006.01)
*F01C 21/00* (2006.01)

(52) U.S. Cl. ..... 417/310; 417/410.5; 418/55.1

(58) Field of Classification Search ..... 417/310, 417/410.5; 418/55.1, 270
See application file for complete search history.

(56) References Cited

U.S. PATENT DOCUMENTS 5,236,316 A * 8/1993 Iio ..... 417/307
6,095,765 A 8/2000 Khalifa
6,190,138 B1 * 2/2001 Hugenroth et al. ..... 417/310
6,210,120 B1 * 4/2001 Hugenroth et al. ..... 417/32
6,231,316 B1 * 5/2001 Wakisaka et al. ..... 417/310

FOREIGN PATENT DOCUMENTS

| | | |
|---|---|---|
| EP | 0385560 | 9/1990 |
| JP | 60182388 | 9/1985 |
| JP | 62067288 | 3/1990 |
| WO | 00/73659 | 12/2000 |

OTHER PUBLICATIONS

English Language Abstract of JP 60-182388.
English Language Abstract of JP 62-067288.

* cited by examiner

*Primary Examiner*—Timothy P. Solak
(74) *Attorney, Agent, or Firm*—Greenblum & Bernstein, P.L.C.

(57) ABSTRACT

A vacuum preventing device of a scroll compressor includes: a chamber formed at one side of a fixed scroll and having a suction pressure hole, a middle pressure hole and a discharge pressure hole communicating with a suction pressure zone, a middle pressure zone and a discharge pressure zone, each formed at a certain portion of an inner circumferential surface; an open and shut member installed inside the chamber and selectively communicating the discharge pressure hole and the suction pressure hole by virtue of a gas pressure of the middle pressure zone and an elastic force of a spring; and a gas leakage preventing unit for preventing a gas leakage in a normal operation by reducing a clearance between an inner wall of the chamber positioned at the side of the discharge pressure hole and the open and shut member.

18 Claims, 10 Drawing Sheets

VACUUM PREVENTING DEVICE OF SCROLL COMPRESSOR

BACKGROUND OF THE INVENTION

1. Field of the Invention

The present invention relates to a scroll compressor and a vacuum preventing device of the scroll compressor, and more particularly, to a scroll compressor and a vacuum preventing device of the scroll compressor that are capable of preventing a compressor from being vacuumized by flowing back a gas at the side of a discharge pressure toward the side of a suction pressure in occurrence of an abnormal operation such as a pump-down or an expansion valve clogging.

2. Description of the Background Art

In general, a compressor, changing a mechanical energy to a latent energy of a compressive fluid, is divided into a reciprocating type, a scroll type, a centrifugal type and a vane type.

Among them, the scroll type compressor has a structure of sucking, compressing and discharging gas by using a rotor like the centrifugal type compressor or the vane type compressor, unlike the reciprocating type compressor which uses a linear reciprocal movement of a piston.

FIG. 1 is a vertical-sectional view showing inside of a conventional scroll compressor.

As illustrated, the conventional scroll compressor includes a case 1 having a gas suction tube (SP) and a gas discharge tube (DP), a main frame 2 and a sub-frame (not shown) installed, respectively, at both upper and lower sides of the inner circumferential surface of the case 1, a rotational shaft 4 coupled at a central portion of a drive motor 3 so as to transmit a rotational force of the drive motor 3, an orbiting scroll 5 installed eccentrically rotatable at an upper portion of the rotational shaft 4 and having an involute curve shaped wrap 5*a* at an upper portion thereof, and a fixed scroll 6 having an involute curve shaped wrap 6*a* so as to form a plurality of compression spaces (P) by being coupled with the orbiting scroll 5.

The case 1 is internally divided into a suction pressure zone (S1) and a discharge pressure zone (S2) by means of a high low pressure separation plate 7, and a middle pressure zone (S3) is formed communicating with the compression space (P).

A gas suction hole 6*b* and a gas discharge hole 6*c* are formed at the side and at the central portion of the fixed scroll 6, and a non-return valve 8 is installed at an upper surface of the fixed scroll 6 to prevent discharged gas from flowing backward.

The main frame 2 and the sub-frame are fixed at the inner circumferential surface of the case 1 by a typical fixing method such as welding, and the fixed scroll 6 is fixed at the lower surface of the high and low pressure separation plate 7 by means of a typical fixing unit such as a bolt.

In case of a pump down or an expansion valve clogging, the suction pressure zone (S1) of the compressor is in a high vacuum state, and at this time, a part of the compressor can be damaged. In order to prevent such a problem, a vacuum preventing device 20 is provided in the conventional art.

FIG. 2 is a vertical-sectional view showing an operation of the vacuum preventing device when the conventional scroll compressor is normally operated, FIG. 3 is a vertical-sectional view showing an operation of the vacuum preventing device when the conventional scroll compressor is not normally operated, and FIG. 4 is a sectional view taken along line A—A of FIG. 2.

With reference to FIGS. 2 and 3, The vacuum preventing device 20 is constructed such that a chamber 10 is formed at one side of the fixed scroll 6 and a discharge pressure hole 11 is formed at an upper surface of the chamber 10, communicating with the discharge pressure zone (S2).

A middle pressure hole 12 is formed at a lower surface of the chamber 10, communicating with the middle pressure zone (S3). A plug 14 having a suction pressure hole 13 is fixed by a fixing pin 15 at the side of an opening portion of the chamber 10. The suction pressure hole 13 communicates with the discharge pressure hole 11.

An open and shut member 17 is movably installed inside the chamber 10 to selectively communicate the discharge pressure hole 11 and the suction pressure hole 13.

A spring 16 is installed at the side of the opening portion of the chamber 10 to limit movement of the open and shut member 17 and provide an elastic force to the open and shut member 17.

The operation of the conventional scroll compressor constructed as described above will now be explained.

First, when power is applied to the drive motor 3, the drive motor 3 rotates the rotational shaft 4, and at this time, the orbiting scroll 5 coupled to the rotational shaft 4 is orbited as long as the eccentric distance.

At this time, the plurality of compression spaces (P) formed between the wrap 5*a* of the orbiting scroll 5 and the wrap 6*a* of the fixed scroll 6 are reduced in their volume as the orbiting scroll 5 is gradually moved toward the center of the fixed scroll 6 according to its continuous orbiting movement.

Owing to the continuous volume reduction of the compression spaces (P), the gas at the suction pressure zone (S2) is sucked into the compression spaces (P) through the suction hole 6*b*, and the sucked gas is discharged to the discharge pressure zone (S2) through the discharge hole 6*c*.

When the compressor is normally operated, since the middle pressure (the pressure at the middle pressure zone) is stronger than the elastic force of the spring 16, the open and shut member 17 overcomes the elastic force of the spring 16 and close (seal) the discharge pressure hole 11. Conversely, if the compressor is not properly operated, since the middle pressure is weaker than the elastic force of the spring 16, the open and shut member 17 submits to the elastic force of the spring and opens the discharge pressure hole 11. At this time, the discharge pressure hole 11 communicates with the suction pressure hole 13.

As the discharge pressure hole 11 and the suction pressure hole 13 communicate with each other, the gas at the discharge pressure zone (S2) flows backward to the suction pressure zone (S1) through the discharge pressure hole 11 and the suction pressure hole 13, so that the vacuum of the compressor is released.

In the conventional scroll compressor, as shown in FIG. 4, a fine clearance (t) is formed between the inner-wall of the chamber 10 and the outer circumferential surface of the open and shut member 17 (that is, a gap formed between an upper surface of the inner wall of the chamber and an upper surface of the open and shut member), in order to induce a smooth sliding movement of the open and shut member 17.

Usually, the clearance (t) is formed with such a minimum size as to allow the open and shut member 17 to slidably move the chamber 10, and so fine as not to allow a gas to be leaked through the discharge pressure hole 11 when the open and shut member 17 closes the discharge pressure hole 11.

The finer the clearance (t) is, the more effectively the gas is blocked but the open and shut member 17 is not smoothly operated. Meanwhile, the greater the clearance (t) is, the more the gas is leaked but the open and shut member 17 is smoothly operated. Thus, in consideration of the open and shut member 17, the clearance (t) is designed and formed within a tolerance limit range.

However, in the conventional art, when the compressor is normally operated, the open and shut member 17 is downwardly pressurized by the gas pressure of the discharge pressure zone (S2), and at this time, the lower surface of the open and shut member 17 is tightly attached to the lower surface of the inner wall of the chamber 10 and at the same time the upper surface of the open and shut member 17 is isolated from the upper surface of the inner wall as much. That is, the clearance (t) is increased beyond the tolerance limit range.

With the increased clearance, the gas at the discharge pressure zone is partially leaked to the suction pressure zone through the clearance, resulting in degradation of the compression efficiency of the compressor.

In addition, in the conventional art, a precision is required so high as to enough satisfy those problems in designing and forming the clearance, fabrication cost is high and a productivity is degraded.

SUMMARY OF THE INVENTION

Therefore, an object of the present invention is to provide a scroll compressor and a vacuum preventing device of the scroll compressor that are capable of heightening a compression efficiency of a compressor by minimizing a clearance between an upper surface of an open and shut member and an upper surface of an inner wall of a chamber by supplying a gas pressure of a middle pressure zone from the lower side of the open and shut member in a normal operation, solving the problem of the conventional art that the gas is leaked through the clearance.

Another object of the present invention is to provide a scroll compressor and a vacuum preventing device of the scroll compressor that are capable of considerably reducing a design and fabrication cost by heightening degree of freedom in designing and fabrication of a clearance by giving a wide tolerance limit range to the clearance.

To achieve these and other advantages and in accordance with the purpose of the present invention, as embodied and broadly described herein, there is provided a vacuum preventing device of a scroll compressor including: a chamber formed at one side of a fixed scroll and having a suction pressure hole, a middle pressure hole and a discharge pressure hole at a certain portion of its inner circumferential surface to communicate with a suction pressure zone, a middle pressure zone and a discharge pressure zone; an open and shut member installed inside the chamber and selectively letting the discharge pressure hole and the suction pressure hole to communicate with each other by virtue of a gas pressure of the middle pressure zone and an elastic force of a spring; and a compression gas receiving part formed at a lower surface of the open and shut member facing the middle pressure hole in order to receive portion of the compression gas of the middle pressure zone.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 5:
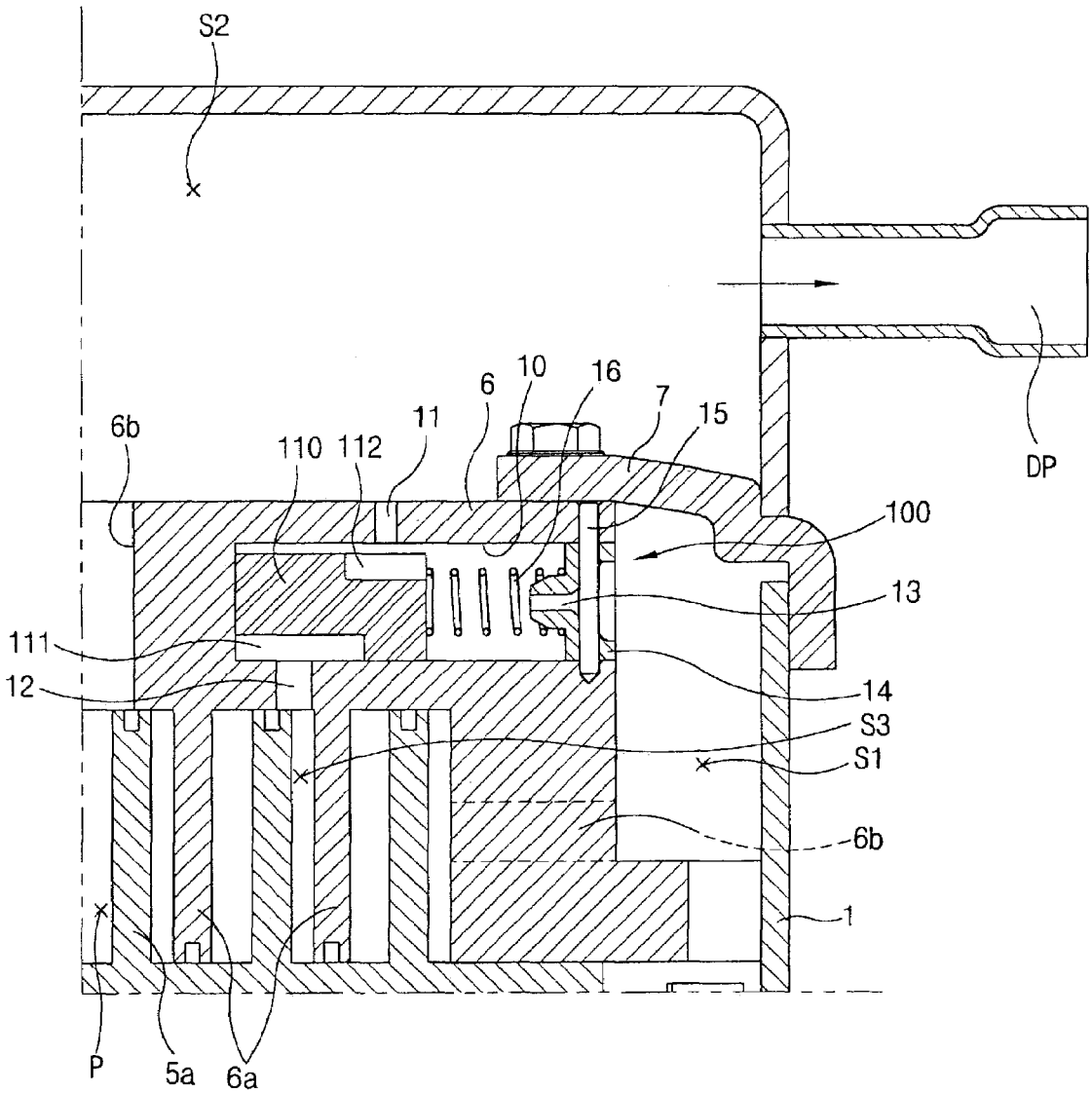
FIG. 5 is a vertical-sectional view showing a portion of a scroll compressor in accordance with a first embodiment of the present invention.
Figure 6:
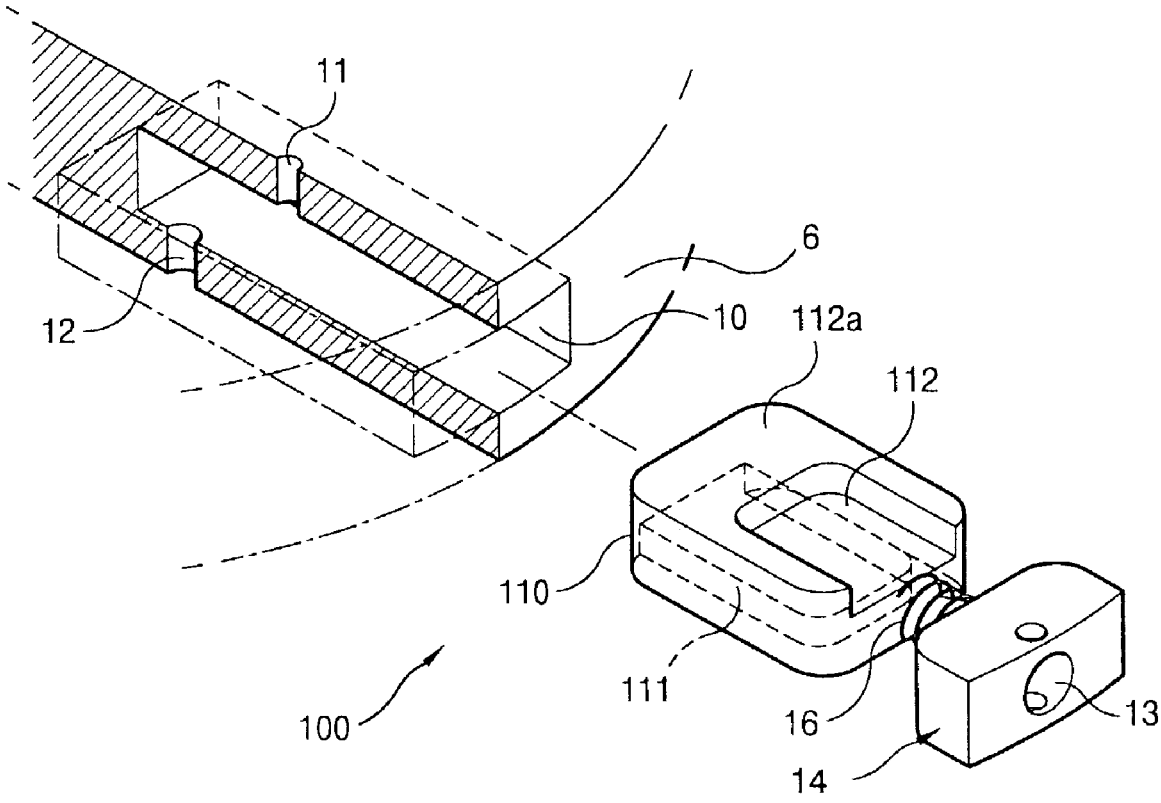
FIG. 6 is an exploded perspective view showing a vacuum preventing device of the scroll compressor of FIG. 5.
Figure 7:
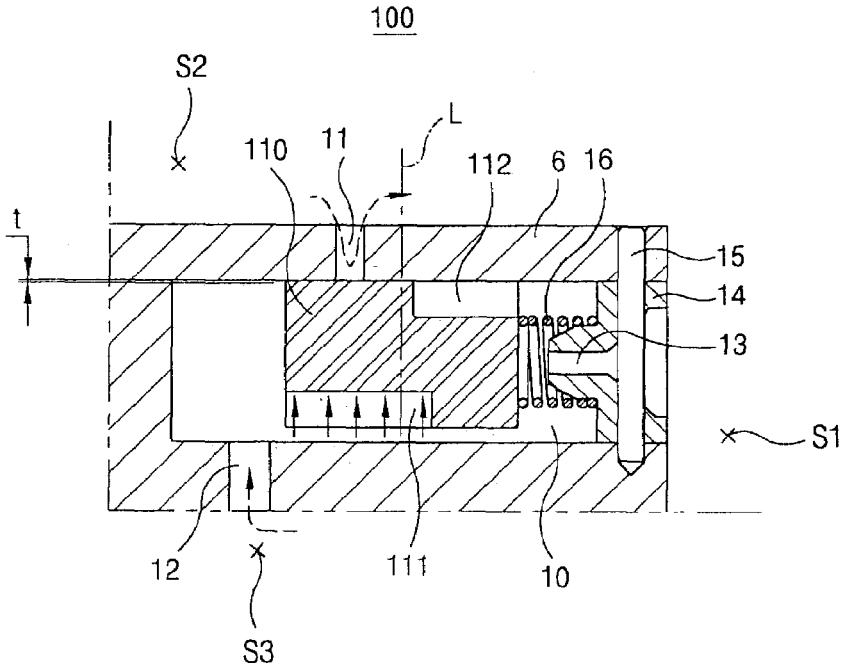
FIG. 7 is a vertical-sectional view showing the operation of the vacuum preventing device when a compressor is normally operated.
Figure 8:
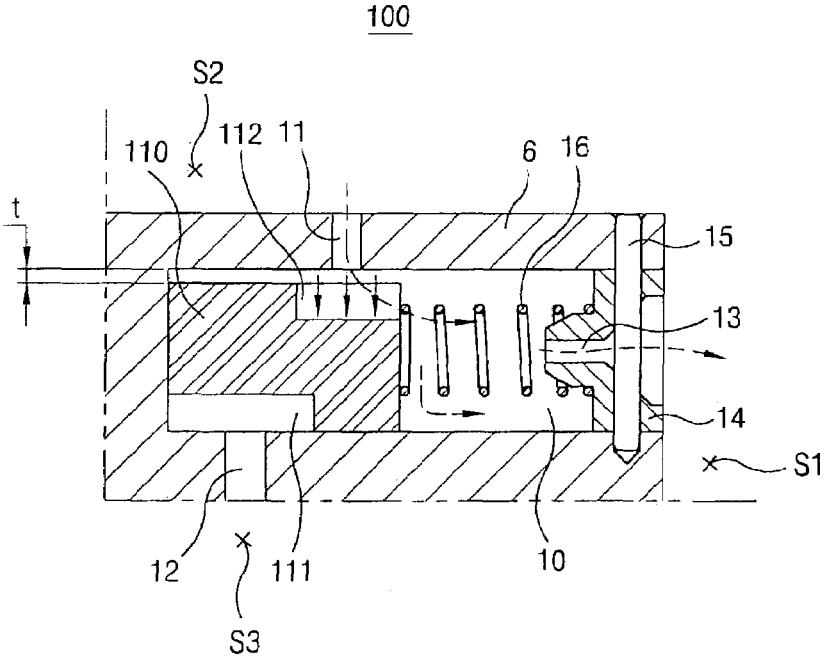
FIG. 8 is a vertical-sectional view showing an operation of the vacuum preventing device when the compressor is not normally operated.

FIG. 5 is a vertical-sectional view showing a portion of a scroll compressor in accordance with a first embodiment of the present invention, FIG. 6 is an exploded perspective view showing a vacuum preventing device of the scroll compressor of FIG. 5, FIG. 7 is a vertical-sectional view showing the operation of the vacuum preventing device when a compressor is normally operated, and FIG. 8 is a vertical-sectional view showing an operation of the vacuum preventing device when the compressor is not normally operated.

As shown in FIGS. 5 through 8, the scroll compressor includes a case 1 divided into a suction pressure zone (S1) for sucking a gas and a discharge pressure zone (S2) for discharging a gas; a fixed scroll 6 fixedly installed inside the case 1; an orbiting scroll 5 coupled to the fixed scroll 6 to form a compression space (P) communicating with an internal middle pressure zone (S3) and coupled to be movable eccentrically in an orbiting manner to the rotational shaft 4 of the drive motor 3 inside the case 1 so as to suck, compress and discharge a gas; and a vacuum preventing unit 100 installed at one side of the fixed scroll 6.

Figure 1:
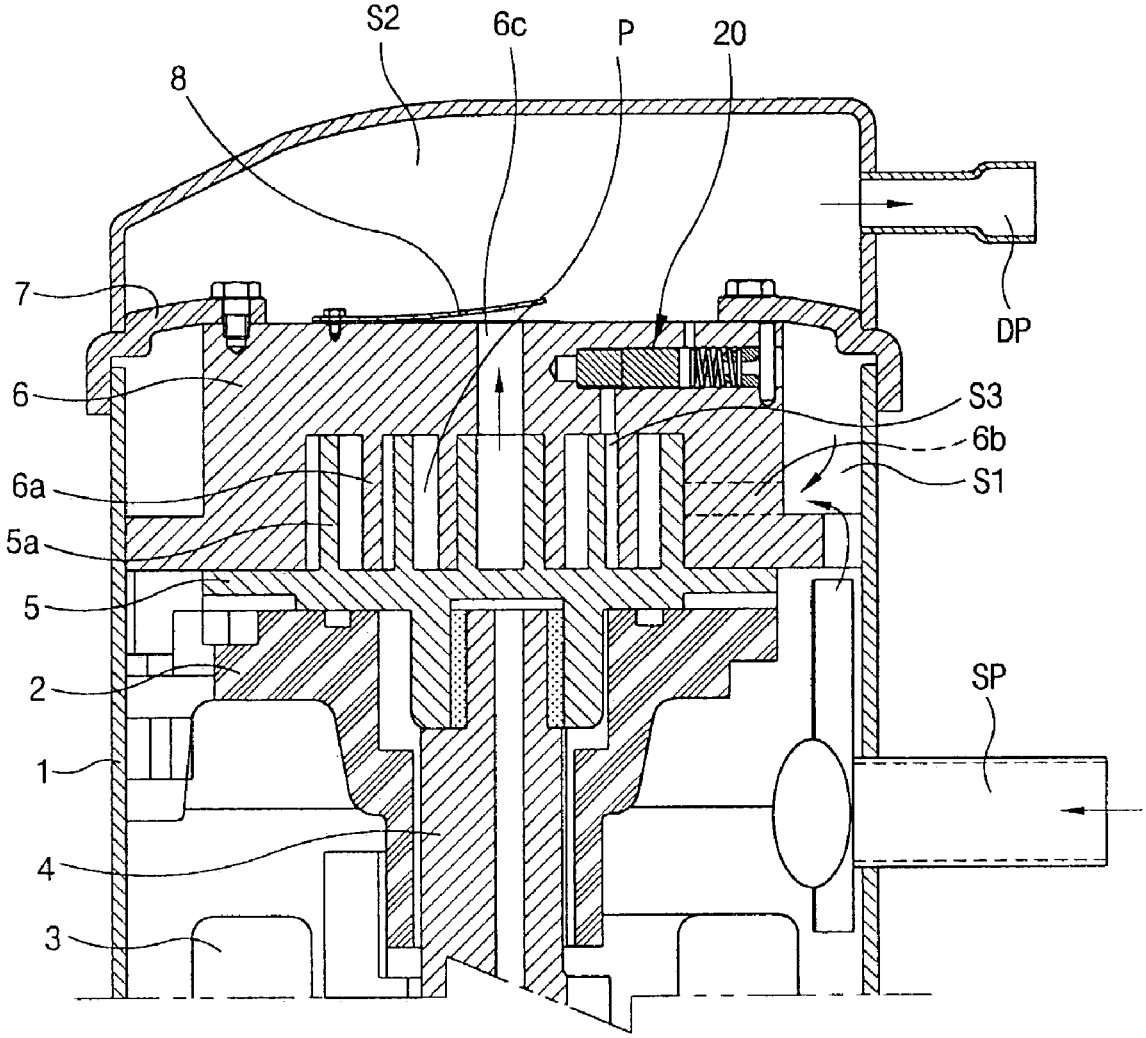
FIG.1 CONVENTIONAL ART
FIG. 1 is a vertical-sectional view showing inside of a scroll compressor in accordance with a conventional art.
Figure 2:
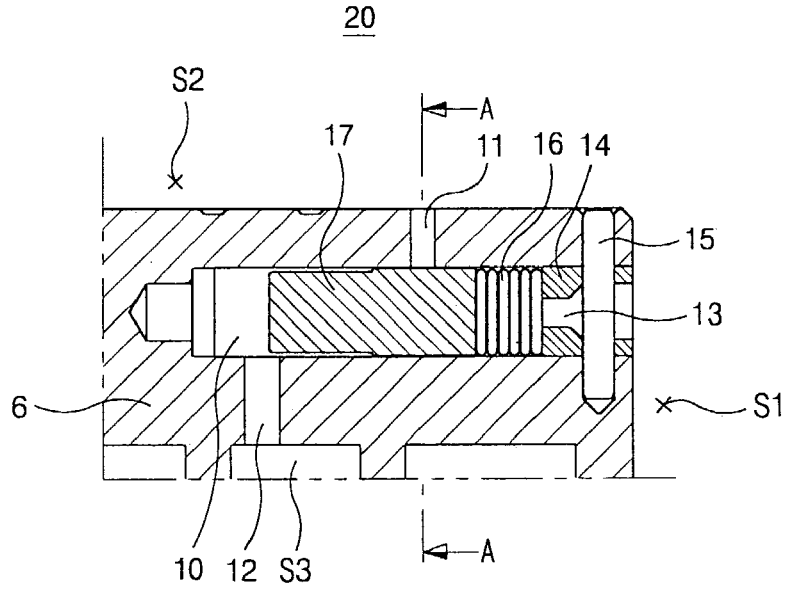
FIG.2 CONVENTIONAL ART
FIG. 2 is a vertical-sectional view showing an operation of a vacuum preventing device of FIG. 1 when the compressor is normally operated.
Figure 3:
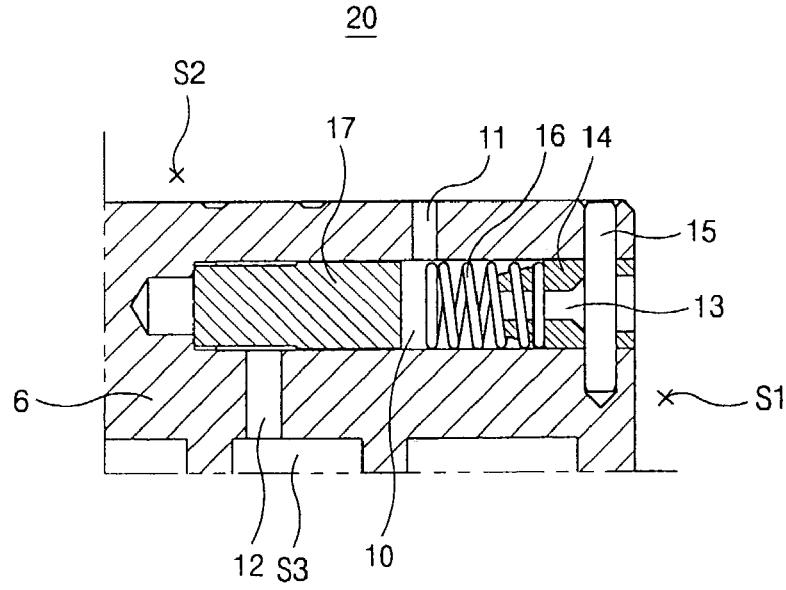
FIG.3 CONVENTIONAL ART
FIG. 3 is a vertical-sectional view showing an operation of the vacuum preventing device of FIG. 1 when the compressor is not normally operated.
Figure 4:
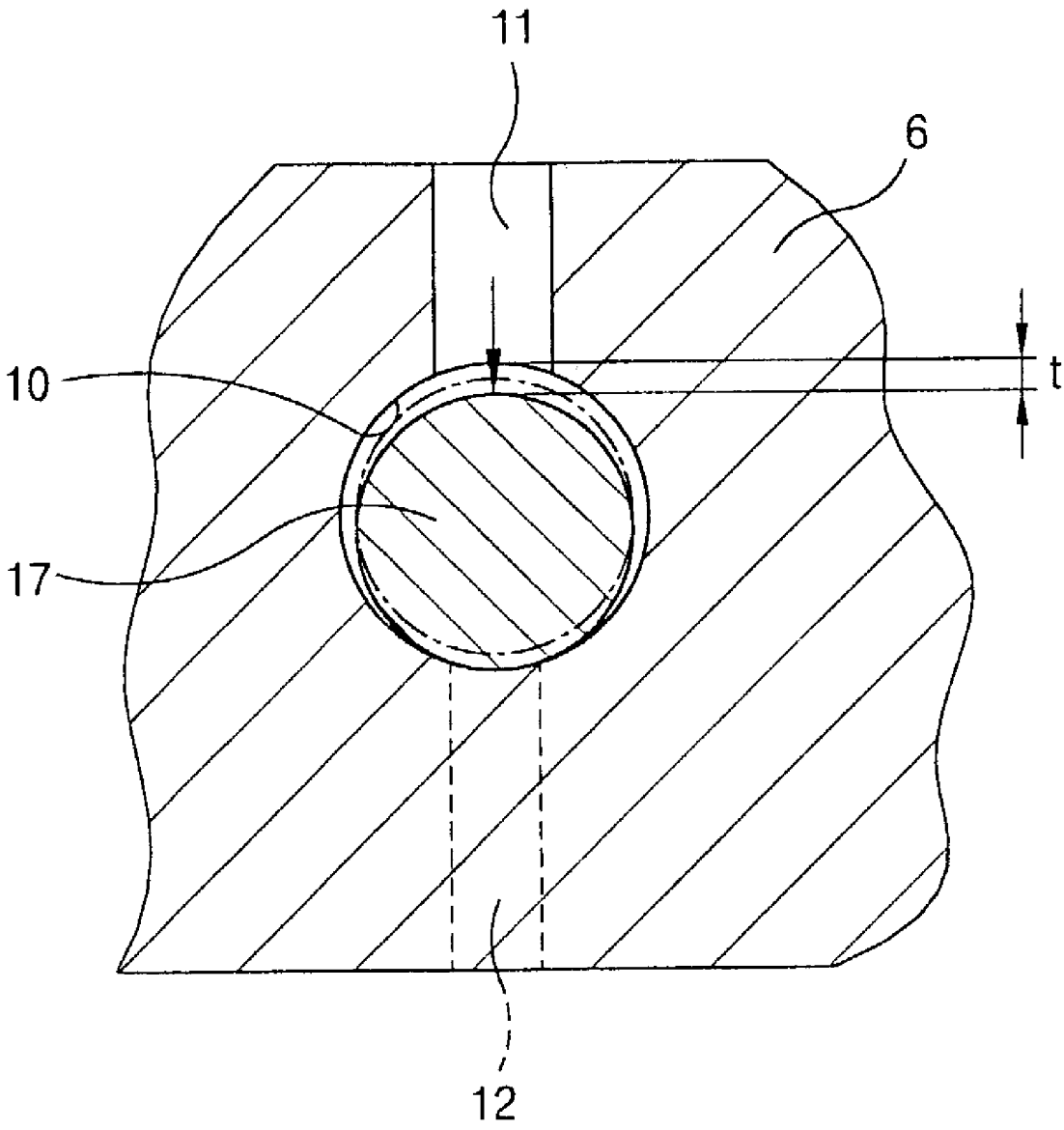
FIG. 4 CONVENTIONAL ART
FIG. 4 is a sectional view taken along line A—A of FIG. 2.

In detail, the case 1 is divided into the suction pressure zone (S1) and the discharge pressure zone (S2) by a high and low pressure separation plate 7, and a gas suction tube (SP) (refer to FIG. 1) is formed at the side of the suction pressure zone (S1) of the case 1 and a gas discharge tube (DP) is formed at the side of the discharge pressure zone (S2) of the case 1.

The orbiting scroll 5 installed eccentrically rotatable at an upper end of the rotational shaft 4 has an involute curve shaped wrap 5*a* at its upper portion, and the fixed scroll 6 coupled to the orbiting scroll 5 includes an involute curve shaped wrap 6*a* at its lower portion.

A gas suction hole 6*b* and a gas discharge hole 6*c* are formed at the side and at the, central portion of the fixed scroll 6, and a non-return open and shut member (refer to FIG. 1) is installed at an upper surface of the fixed scroll 6 to prevent discharged gas from flowing backward.

As mentioned above, in the case of pump down or the expansion valve clogging, the suction pressure zone (S1) of the compressor is in a high vacuum state, and at this time, parts of the compressor can be damaged. In order to prevent this problem, the vacuum preventing device 100 is installed at the fixed scroll 6.

The vacuum preventing device 100 is constructed such that a chamber 10 is formed at one side of the fixed scroll 6 and a discharge pressure hole 11 is formed communicating with the discharge pressure zone (S2) is formed at an upper surface of the chamber 10.

A middle pressure hole 12 communicating with the middle pressure zone (S3) is formed at a lower surface of the chamber 10, a plug 14 having a suction pressure hole 13 is fixed by a fixing pin 15 at the side of an opening portion of the chamber 10. The suction pressure hole 13 communicates with the discharge pressure hole 11.

An open and shut member 17 is movably installed inside the chamber 10 to selectively communicate the discharge pressure hole 11 and the suction pressure hole 13.

A spring 16 is installed at the side of the opening portion of the chamber 10 to limit movement of the open and shut member 17 and provide an elastic force to the open and shut member 17.

The characteristic construction of the present invention will now be described in detail.

When the compressor is normally operated, a pressure at the discharge pressure zone (S2) is increased so that the open and shut member 110 of the chamber 10 is pressurized downwardly through the discharge pressure hole 11 communicating with the discharge pressure zone (S2).

At this time, by minimizing the clearance (t) within a tolerance by attaching the open and shut member 110 onto the upper surface of the inner wall of the chamber 10, a gas leakage through the clearance (t) can be effectively prevented.

In detail, as shown in FIGS. 7 and 8, a concave compression gas reception portion 111 is formed at a lower surface of the open and shut member 110, and the compression gas reception portion 111 is opened inwardly of the chamber 10 (that is, toward the center of the fixed scroll.

As for the compression gas reception portion 111, it is formed inclined toward the middle pressure zone (S3) on the basis of a vertical central line (L) of the open and shut member 110 and adjacent to the inner wall of the chamber 10 to form a closed space there.

A gas pressurizing area of the compression gas reception portion 111 is preferably formed wider than that of the middle pressure hole 12.

This is because by allowing the compression gas to remain as much as possible in the closed space of the compression gas reception portion 111, the pressure of the compression gas is increased, by which the open and shut member 110 can close the discharge pressure hole 11 more tightly.

In the present invention, in order to tightly attach the open and shut member 110 to the discharge pressure hole 11, another structure is also adopted besides the structure in which the compression gas reception portion 111 is formed at the lower portion of the open and shut member 110.

That is, a suction gas reception portion 112 is formed at an upper surface of the open and shut member 110. A pressurizing area of the suction has reception portion 112 is preferably formed smaller than that of the compression gas reception portion 111.

Referring to the suction gas reception portion 112, it is formed inclined toward the suction pressure zone (S1) on the basis of the vertical central line (L) of the open and shut member 110 and opened outwardly of the chamber 10 (that is, toward the outer circumference of the fixed scroll).

The operation of the suction gas reception portion 112 will now be described.

When the compressor is normally operated, the pressure of the compression space is introduced into the middle pressure hole 12 to pressurize the open and shut member 110, and at this time, the open and shut member 110 overcomes the elastic force of the spring 16, slidably closing the discharge pressure hole 11.

While the open and shut member 110 closes the discharge pressure hole 11, a discharge pressure is applied to the portion adjacent to the discharge pressure hole 11 as well as to the discharge pressure hole 11.

However, in the case that the suction gas reception portion 112 is formed at the upper surface of the open and shut member 110, a suction pressure is applied into the suction gas reception portion 112 and the discharge pressure is partially offset by the suction pressure, resulting in that the middle pressure is relatively higher than the discharge pressure and accordingly the opening and shut member 110 tightly closes the discharge pressure hole 11.

As shown in FIG. 6, when the compressor is normally operated, a portion 112*a* except for the suction gas reception portion 112 of the entire upper surface of the open and shut member 110 closes the discharge pressure hole 11. At this time, it is preferred that the discharge pressure hole 11 is positioned at the right center of the portion 112*a*.

If the discharge pressure hole 13 is not positioned at the right center of the portion 112*a*, the discharge pressure is concentrated to only one side of the portion 112*a*, degrading the closing efficiency.

In this respect, in order not to allow the open and shut member 110 to be arbitrarily rotated within the chamber 10, the chamber 10 and the open and shut member 110 is preferably formed in a non-circle shape or in a rectangular form when vertically projected.

Figure 9:
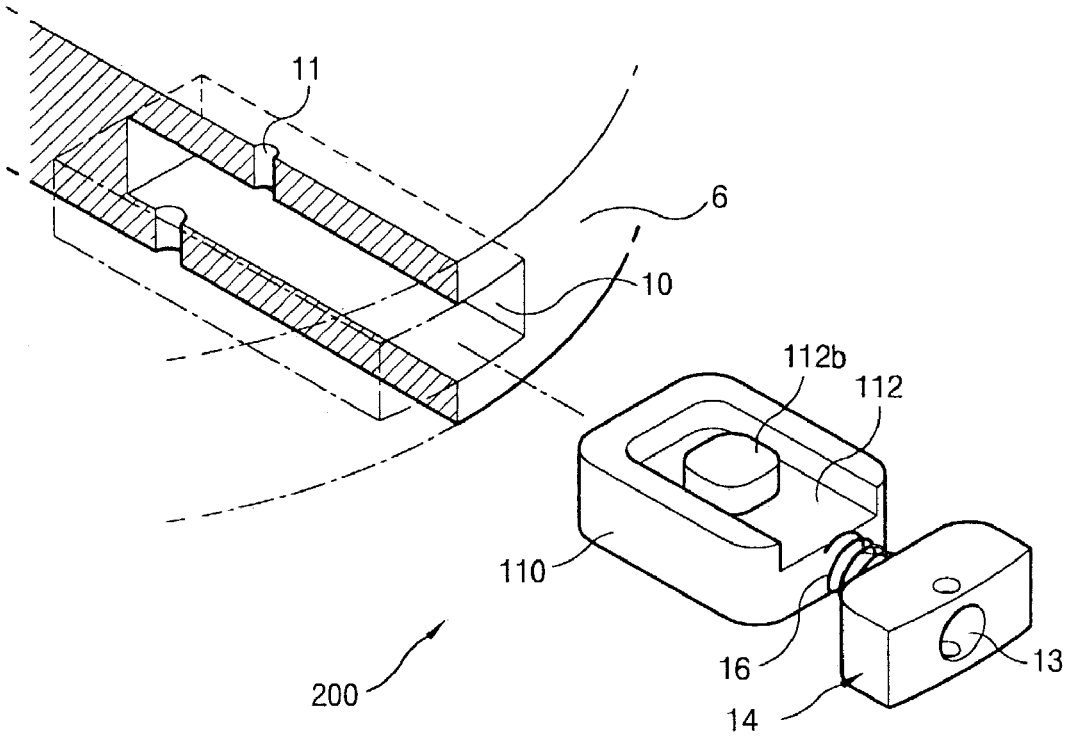
FIG. 9 is an exploded perspective view of a scroll compressor in accordance with a second embodiment of the present invention.
Figure 10:
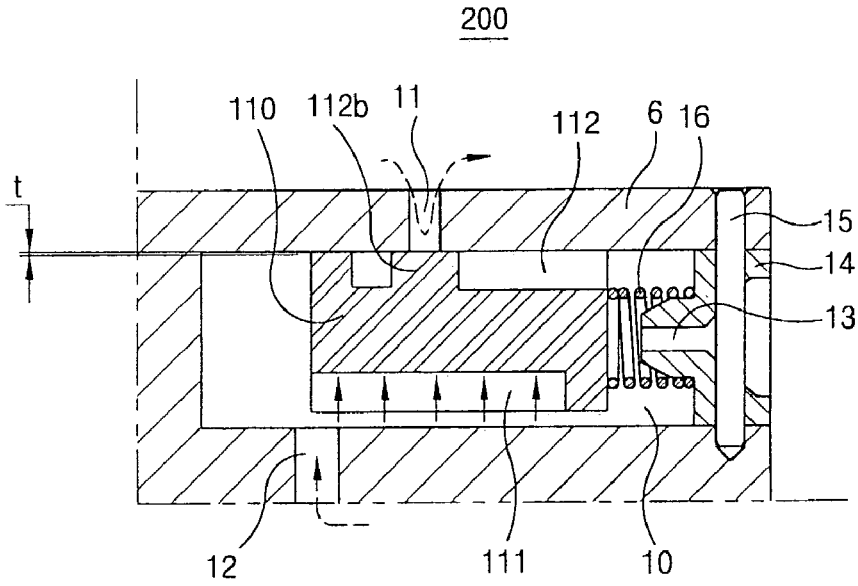
FIG. 10 is a vertical-sectional view showing an operation of a vacuum preventing device when the compressor of FIG. 9 is normally operated.

FIG. 9 is an exploded perspective view of a scroll compressor in accordance with a second embodiment of the present invention, and FIG. 10 is a vertical-sectional view showing an operation of a vacuum preventing device when the compressor of FIG. 9 is normally operated.

As shown in FIGS. 9 and 10, a vacuum preventing device 200 in accordance with the second embodiment of the present invention is constructed such that a tilting moment preventing protrusion 112*b* is formed at the bottom of the suction gas reception portion 112 and a discharge pressure hole 11 is positioned at the right center of the upper surface of the tilting moment preventing protrusion 112*b* when the compressor is normally operated.

In this manner, the resultant forces of the middle pressure applied to the lower portion of the open and shut member 110 and the discharge pressure applied to the upper portion of the open and shut member 110 work to the same vertical central line, thereby preventing the tilting moment of the open and shut member 110.

Figure 11:
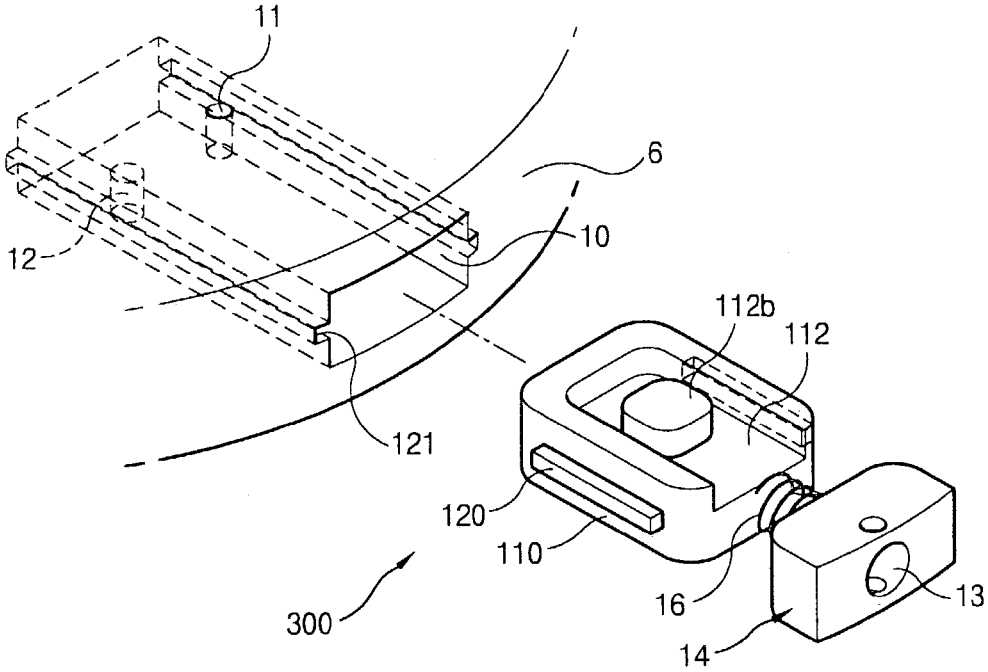
FIG. 11 is an exploded perspective view showing a vacuum preventing device of a scroll compressor in accordance with a third embodiment of the present invention.

FIG. 11 is an exploded perspective view showing a vacuum preventing device of a scroll compressor in accordance with a third embodiment of the present invention.

As illustrated, a vacuum preventing device 300 in accordance with the third embodiment of the present invention includes a guide groove 121 and a guide rail 120 which are generally used at an inner wall of the chamber 10 and an outer surface of the open and shut member 110, respectively, in order to prevent a smooth sliding movement of the open and shut member 110 and the tilting moment.

In this respect, conversely, the guide rail 120 can be installed at the inner wall of the chamber 10 and the guide groove 121 can be installed at the outer surface of the open and shut member 110.

Figure 12:
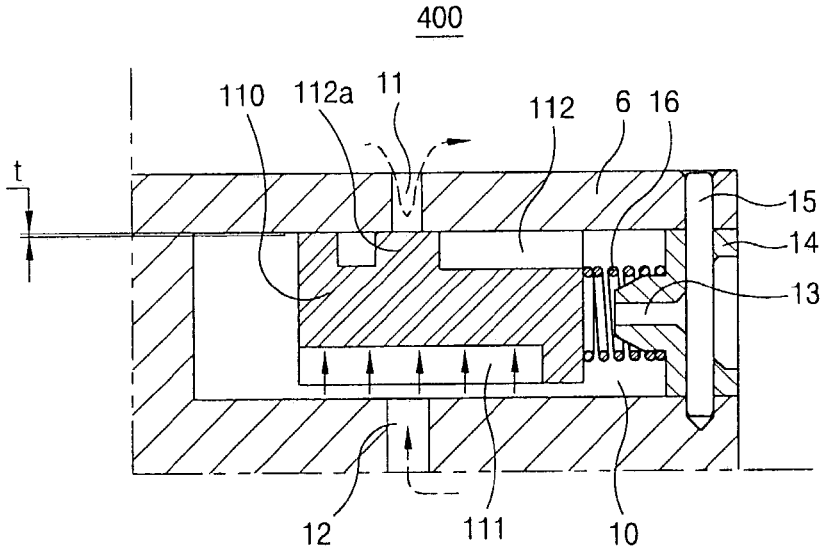
FIG. 12 is a vertical-sectional view showing a vacuum preventing device of a scroll compressor in accordance with a fourth embodiment of the present invention.

FIG. 12 is a vertical-sectional view showing a vacuum preventing device 400 of a scroll compressor in accordance with a fourth embodiment of the present invention.

As illustrated, a vacuum preventing device in accordance with the fourth embodiment of the present invention is constructed such that the middle pressure hole 12 and the discharge pressure hole 11 are positioned on the same vertical line to make each resultant force to work on the same vertical central line, thereby preventing the tilting moment of the open and shut member.

Figure 13:
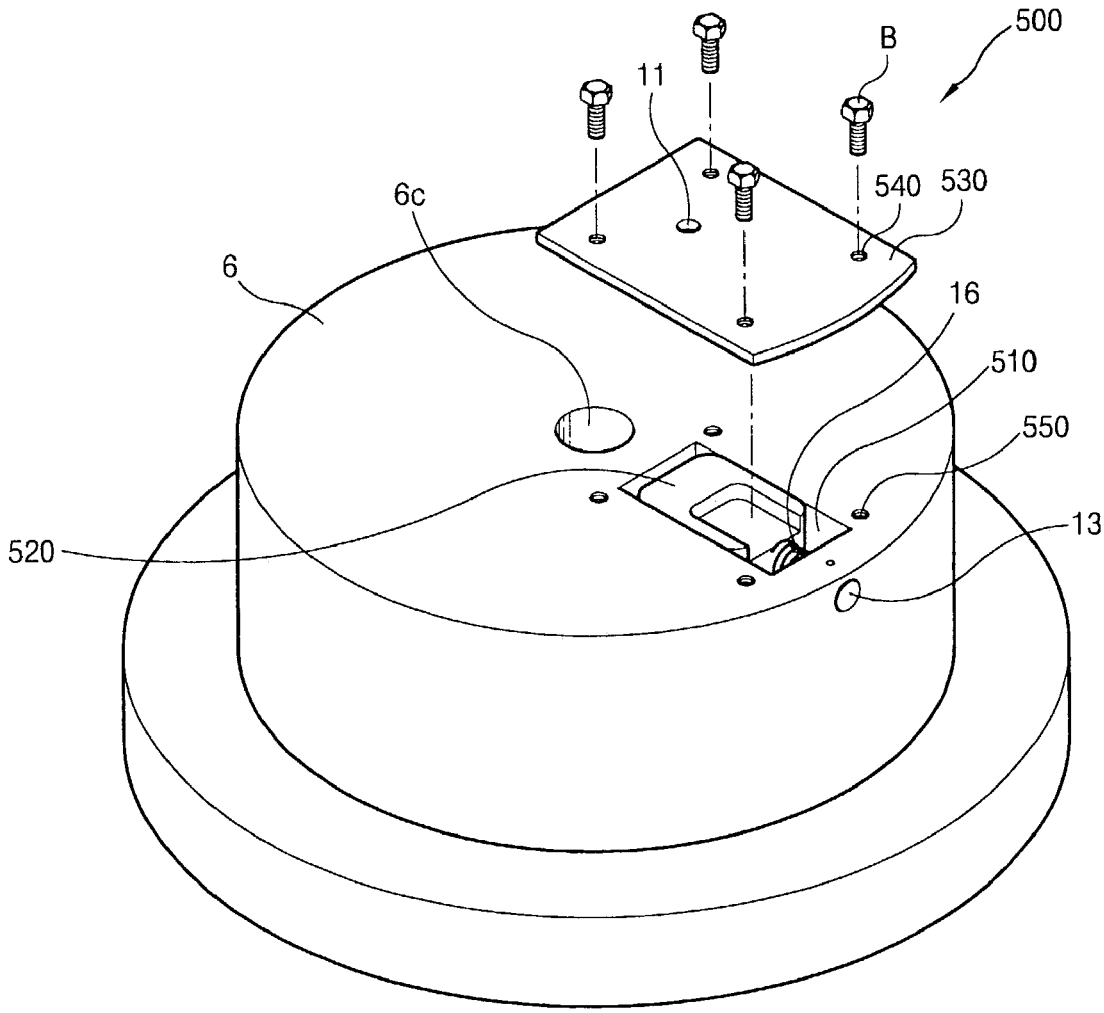
FIG. 13 is an exploded perspective view showing a vacuum preventing device of a scroll compressor in accordance with a fifth embodiment of the present invention.
Figure 14:
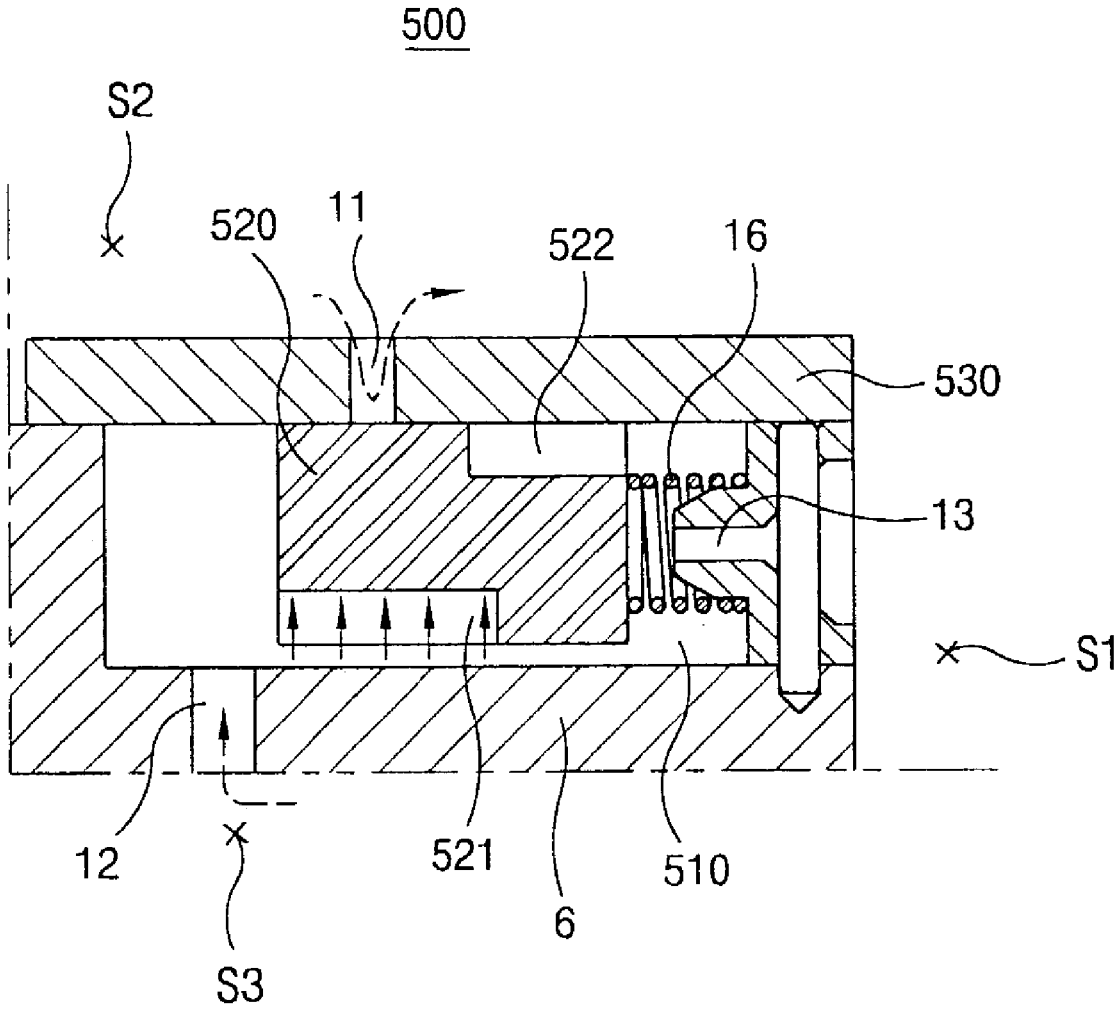
FIG. 14 is a vertical-sectional view showing the vacuum preventing device of a scroll compressor in accordance with the fifth embodiment of the present invention.

FIG. 13 is an exploded perspective view showing a vacuum preventing device of a scroll compressor in accordance with a fifth embodiment of the present invention, and FIG. 14 is a vertical-sectional view showing the vacuum preventing device of a scroll compressor in accordance with the fifth embodiment of the present invention.

As illustrated, a vacuum preventing device 500 in accordance with the fifth embodiment of the present invention includes: a chamber 510 formed at an upper surface of the fixed scroll 6 and having a suction pressure hole 13 communicating with the suction pressure zone (S1) formed at one side and a middle pressure hole 12 communicating with the middle pressure zone (S3) formed at the other side; a cover member 530 coupled at an upper surface of the fixed scroll 6 to cover the chamber 510 and having a discharge pressure hole 11 communicating with the discharge pressure zone (S2) formed at the center thereof; an open and shut member 520 installed to be movable elastically by virtue of the spring 16 in the chamber 510 in order to selectively allow the discharge pressure hole 11 and the suction pressure hole 13 to communicate with each other; and a compression gas receiving part 521 formed at a lower surface of the open and shut member 520 facing the middle pressure hole 12.

A suction gas receiving part 522 is formed at an upper surface of the open and shut member 520 facing the discharge pressure hole 11. The compression gas receiving part 521 are formed to be recess.

As the bolt (B) is engaged into the through hole 540 and the engaging hole 550, the cover member is fixed to the upper surface of the fixed scroll 6.

An operation and effect of the scroll compressor and the vacuum preventing device will now be described.

In brief, the compressor is operated that as the orbiting scroll 5 orbits by virtue of the drive motor 3, it sucks the gas of the suction pressure zone (S1) into the compression spaces (P), compresses it in the compression spaces (P) and discharges it to the discharge pressure zone (S2).

The vacuum preventing device 100 is operated that when the compressor is normally operated, since the pressure of the middle pressure zone (S3) is stronger than the elastic force of the spring 16, the open and shut member 110 overcomes the elastic force of the spring 16 and closes the discharge pressure hole 11.

Reversely, as shown in FIG. 8, when the compressor is not normally operated, since the middle pressure is weaker than the elastic force of the spring 16, the open and shut member 110 submits the elastic force of the spring and opens the discharge pressure hole 11, and at this time, the discharge pressure hole 11 communicates with the suction pressure hole 13.

As the discharge pressure hole 11 and the suction pressure hole 13 communicate with each other, the gas of the discharge pressure zone (S2) flows backward to the suction pressure zone (S1) through the suction pressure hole 13, so that the vacuum of the compressor is released.

In the present invention, in a state that the open and shut member 110 closes the discharge pressure hole 11, the discharge side pressure is applied to the portion adjacent to the discharge pressure hole 11 as well as to the discharge pressure hole 11.

At this time, since the suction gas reception portion 111 is formed at the upper surface of the open and shut member 110, the suction side pressure is applied into the suction gas reception portion 111, and accordingly, the discharge side pressure is partially offset as much owing to the suction side pressure. At the same time, the pressure of the compression gas collected to the compression gas reception portion 111 pressurizes the open and shut member 110 upwardly.

Thanks to these operations, the middle pressure is stronger than the discharge pressure, so that the open and shut member 110 can tightly close the discharge pressure hole 11 without a gas leakage.

As so far described, the scroll compressor and the vacuum preventing device of the scroll compressor of the present invention have the following advantages.

That is, the clearance between the chamber and the open and shut member is minimized by using the pressure of the middle pressure zone, so that when the compressor is normally operated, a gas leakage can be effectively prevented from the clearance. Thus, the compression efficiency of the compressor can be heightened. In addition, since the tolerance limit range in designing and fabrication of the clearance is widened, the fabrication cost can be considerably reduced and its productivity can be improved.

As the present invention may be embodied in several forms without departing from the spirit or essential characteristics thereof, it should also be understood that the above-described embodiments are not limited by any of the details of the foregoing description, unless otherwise specified, but rather should is be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A vacuum preventing device of a scroll compressor comprising:

a chamber formed at one side of a fixed scroll and having a suction pressure hole, a middle pressure hole and a discharge pressure hole at a certain portion of its inner circumferential surface to communicate with a suction pressure zone, a middle pressure zone and a discharge pressure zone;

an open and shut member installed inside the chamber and selectively allowing the discharge pressure hole and the suction pressure hole to communicate with each other by virtue of a gas pressure of the middle pressure zone and an elastic force of a spring; and a compression gas receiving part formed at a lower surface of the open and shut member facing the middle pressure hole in order to receive portion of the compression gas of the middle pressure zones, wherein the compression gas receiving part is positioned inclined toward the suction pressure zone on the basis of a vertical central line of the open and shut member.

2. The device of claim 1, wherein the compression gas receiving part is a recess.

3. The device of claim 1, wherein a gas pressuring area of the compression gas receiving part is formed larger than that of the middle pressure hole.

4. The device of claim 1, wherein the compression gas receiving part is opened inwardly toward a center of the fixed scroll.

5. The device of claim 1, wherein the compression gas receiving part forms a hermetic space adjacent to an inner wall inside the chamber.

6. The device of claim 1, wherein a suction gas receiving recess is formed at an upper surface of the open and shut member.

7. The device of claim 6, wherein a gas pressurizing area of the suction gas receiving recess is smaller than that of the compression gas receiving part.

8. The device of claim 6, wherein the suction gas receiving recess is positioned inclined toward the suction pressure zone on the basis of the vertical central line of the open and shut member.

9. The device of claim 6, wherein the suction gas receiving recess is opened outwardly toward an outer circumference of the fixed scroll.

10. The device of claim 6, wherein when the discharge pressure hole is optimally closed, the discharging pressure hole is positioned at a central portion of a contacting surface, out of the entire upper surface of the open and shut member, that contacts an inner-upper surface of the chamber.

11. The device of claim 6, wherein a tilting moment preventing protrusion is formed at the bottom of the suction gas receiving recess.

12. The device of claim 11, wherein when the discharge pressure hole is optimally closed, the suction gas receiving recess is positioned inclined toward the suction pressure zone on the basis of the vertical central line of the open and shut member.

13. The device of claim 1, wherein a guide rail is formed at either the inner wall of chamber or the outer surface of open and shut member and a guide groove is formed at the opposite side.

14. The device of claim 1, wherein the compression gas receiving part allows the middle pressure hole and the discharge pressure hole to be positioned on the same vertical line.

15. A vacuum preventing device of a scroll compressor comprising:

a chamber formed at one side of a fixed scroll and having a suction pressure hole, a middle pressure hole and a discharge pressure hole at a certain portion of its inner circumferential surface to communicate with a suction pressure zone, a middle pressure zone and a discharge pressure zone;

an open and shut member installed inside the chamber and selectively allowing the discharge pressure hole and the suction pressure hole to communicate with each other by virtue of a gas pressure of the middle pressure zone and an elastic force of a spring; and a compression gas receiving part formed at a lower surface of the open and shut member facing the middle pressure hole in order to a receive portion of the compression gas of the middle pressure zone, wherein the compression gas receiving part is opened inwardly toward a center of the fixed scroll.

16. A vacuum preventing device of a scroll compressor comprising:

a chamber formed at one side of a fixed scroll and having a suction pressure hole, a middle pressure hole and a discharge pressure hole at a certain portion of its inner circumferential surface to communicate with a suction pressure zone, a middle pressure zone and a discharge pressure zone;

an open and shut member installed inside the chamber and selectively allowing the discharge pressure hole and the suction pressure hole to communicate with each other by virtue of a gas pressure of the middle pressure zone and an elastic force of a spring; and a compression gas receiving part formed at a lower surface of the open and shut member facing the middle pressure hole in order to receive a portion of the compression gas of the middle pressure zone, wherein a gas pressurizing area of the suction gas receiving recess is smaller than that of the compression gas receiving part.

17. A vacuum preventing device of a scroll compressor comprising:

a chamber formed at one side of a fixed scroll and having a suction pressure hole, a middle pressure hole and a discharge pressure hole at a certain portion of its inner circumferential surface to communicate with a suction pressure zone, a middle pressure zone and a discharge pressure zone;

an open and shut member installed inside the chamber and selectively allowing the discharge pressure hole and the suction pressure hole to communicate with each other by virtue of a gas pressure of the middle pressure zone and an elastic force of a spring; and a compression gas receiving part formed at a lower surface of the open and shut member facing the middle pressure hole in order to receive a portion of the compression gas of the middle pressure zone, wherein the suction gas receiving recess is positioned inclined toward the suction pressure zone on the basis of the vertical central line of the open and shut member.

18. A vacuum preventing device of a scroll compressor comprising:

a chamber formed at one side of a fixed scroll and having a suction pressure hole, a middle pressure hole and a discharge pressure hole at a certain portion of its inner circumferential surface to communicate with a suction pressure zone, a middle pressure zone and a discharge pressure zone;

an open and shut member installed inside the chamber and selectively allowing the discharge pressure hole and the suction pressure hole to communicate with each other by virtue of a gas pressure of the middle pressure zone and an elastic force of a spring; and a compression gas receiving part formed at a lower surface of the open and shut member facing the middle pressure hole in order to receive a portion of the compression gas of the middle pressure zone, wherein the suction gas receiving recess is opened outwardly toward an outer circumference of the fixed scroll.

* * * * *